US006793476B2

(12) United States Patent
Bryja et al.

(10) Patent No.: US 6,793,476 B2
(45) Date of Patent: Sep. 21, 2004

(54) APPARATUS FOR PROVIDING AGING EFFECT FOR BRICK

(75) Inventors: James G. Bryja, Johnson City, TN (US); Robert W. O'Quinn, Johnson City, TN (US); Robert W. Keyes, Corbin, KY (US)

(73) Assignee: General Shale Products LLC, Johnson City, TN (US)

( * ) Notice: Subject to any disclaimer, the term of this patent is extended or adjusted under 35 U.S.C. 154(b) by 301 days.

(21) Appl. No.: 10/002,617

(22) Filed: Dec. 5, 2001

(65) Prior Publication Data

US 2003/0102598 A1 Jun. 5, 2003

(51) Int. Cl.[7] ..... B28B 11/08

(52) U.S. Cl. ..... 425/145; 264/293; 264/314; 425/340; 425/385

(58) Field of Search ..... 264/293, 314, 264/296; 425/145, 340, 383, 384, 385, 386, 387.1, 388, 389, 390, 391, 392, 393, 394, 395, 396, 397, 398, 399, 400, 401, 402, 403, 403.1, 405.1

(56) References Cited

U.S. PATENT DOCUMENTS

| | | | | | |
|---|---|---|---|---|---|
| 1,580,519 | A | * | 4/1926 | Meyer | 425/296 |
| 2,537,920 | A | * | 1/1951 | Smith | 425/579 |
| 4,050,865 | A | * | 9/1977 | Drostholm et al. | 425/354 |
| 4,078,038 | A | * | 3/1978 | Gresham, Jr. | 425/335 |
| 4,108,586 | A | * | 8/1978 | Gresham, Jr. | 425/385 |
| 4,139,593 | A | | 2/1979 | Holz et al. | |
| 4,147,491 | A | * | 4/1979 | Postell, Jr. | 425/385 |
| 4,229,156 | A | * | 10/1980 | Hyytinen | 425/145 |
| 4,263,240 | A | | 4/1981 | Postell, Jr. | |
| 4,543,052 | A | * | 9/1985 | Stevens | 425/123 |
| 4,568,260 | A | * | 2/1986 | Paul et al. | 425/385 |
| 4,579,706 | A | * | 4/1986 | Elkins | 425/346 |
| 4,640,671 | A | * | 2/1987 | Wright | 425/351 |
| 5,084,282 | A | * | 1/1992 | Stuart et al. | 425/385 |
| 5,643,616 | A | * | 7/1997 | Hess | 425/195 |
| 5,851,567 | A | * | 12/1998 | Proni | 425/346 |
| 6,093,012 | A | * | 7/2000 | Hess et al. | 425/346 |
| 6,575,727 | B2 | * | 6/2003 | Ciccarello et al. | 425/343 |
| 6,596,208 | B1 | * | 7/2003 | Glick et al. | 264/78 |

FOREIGN PATENT DOCUMENTS

| | | | |
|---|---|---|---|
| EP | 262278 | * | 4/1988 |

* cited by examiner

*Primary Examiner*—Tim Heitbrink
(74) *Attorney, Agent, or Firm*—Reed Smith LLP; Stanley P. Fisher, Esq.; Juan Carlos A. Marquez, Esq.

(57) ABSTRACT

A work table supports a grid of green brick aligned in longitudinal and transverse row for indexing movement by a hydraulic cylinder actuated pusher. The brick are indexed longitudinally beneath a first transverse row of embossing devices in a transverse row aligned with one embossing device being over every other brick of the transverse row. Following actuation of the first transverse row of embossing devices the brick are indexed beneath a second transverse row of embossing devices each of which is aligned with the brick that were not embossed by the first transverse row of embossing devices. Ramps are provided below the rows of embossing devices to elevate the brick above the next adjacent rows so that the brick being embossed is at a higher elevation than the adjacent brick.

11 Claims, 7 Drawing Sheets

APPARATUS FOR PROVIDING AGING EFFECT FOR BRICK

BACKGROUND OF THE INVENTION

The present invention relates to the manufacture of brick. More specifically, the invention relates to the manufacture of brick having an aged design, old brick appearance, or handmade look. The words "old brick" as used herein means brick having the appearance of previously used salvaged brick and/or brick having an old, handmade, antiqued design or appearance.

There has been a long standing demand for old or used brick for use in certain types of high quality building construction. However, there is a great deal of labor and expense involved in salvaging old brick from demolished buildings and the like and in removing mortar and otherwise preparing such brick so as to make it capable of being used in new construction. The brick industry has consequently attempted to provide new brick having the appearance of old or similar brick designs. One method of producing this effect is to tumble green brick off of a conveyor. The green (unfired) brick are dropped on and tumble down a ramp. This process produces a very random pattern of flattened or mashed corners and edges. Because of the nature of this process, the brick must be handled by humans for stacking, loading and unloading, which is very labor intensive and expensive. Another prior known procedure for providing brick having a Tudor appearance with rounded face edges is to tumble newly finished brick together so as to mar the surface of the brick. Unfortunately, tumbling of the brick results in breakage and loss of a substantial portion of the tumbled brick and is consequently an expensive procedure.

Prior U.S. Pat. Nos. 4,147,491 and 4,263,240 of Postell, Jr. disclose identical structures for forming simulated old brick. More specifically, a transverse conveyor 14 conveys a slug S of clay into a position adjacent a pusher 18 which is activated to move the slug onto a support plate 12 as shown in FIG. 1 of these patents. The slug is indexed through a wire cutter 20 comprising a plurality of vertical wires 22 spaced from each other a distance equal to the brick height. Two rows of rollers having a peripheral embossed surface are provided above the path of travel of the brick so that the rollers engage alternate bricks that are elevated into contact with the rollers by ramps 24 or 26 as shown in FIGS. 7A through 7J of the patent drawings. However, the rolling contact of each of the embossing rollers with the brick results in repetitive production of the same design. Moreover, rolling contact of a roller with a brick is incapable of providing complicated designs that would be possible with a face-to-face planar contact of a planar embossing device moved perpendicular into contact with the face of the green brick. In addition some brick designs such as those requiring rounded corner edges require exact justification (positioning) of the embossed design on the roller relative to the brick which positioning is difficult to obtain and retain.

Another prior art approach is that of Paul et al. U.S. Pat. No. 4,568,260 which discloses a brick texturing system in which rows of brick pass under one or the other of endless belts having slapping elements 18 for engaging the green brick to give them a textured appearance. This patent also discloses means for lifting alternate rows of brick for engagement with the slapping elements 18.

Another problem with many previously known apparatus and methods for creating simulated old brick is that they provide only a small number of brick designs so that walls or other building elements constructed of such brick have a wallpaper appearance due to the repetitive use of the same design which is visually evident in the finished wall or building element. The use of a large number of brick having the same design in the same building structure is consequently undesirable and reduces the value of the brick.

Therefore, it is the primary object of the present invention to provide a new and improved apparatus and method for making new brick having the appearance of old brick.

Another object of the present invention is the provision of an apparatus and method capable of providing simulated old brick having a large number of different surface configurations and appearances.

Yet another object of the present invention is the provision of a new and improved apparatus and method employing linear movement of a die into face-to-face contact with a green brick face for effecting a textured design on the brick face. The word "die" as used herein means any of various tools or devices, including molds, for imparting a desired shape, form, or finish to a material or for impressing an object or material.

Another object of the invention is to provide brick with an old or handmade appearance which allows for mechanical handling, loading and unloading of the brick because the embossed brick remain in linear stacks.

BRIEF SUMMARY OF THE INVENTION

Achievement of the foregoing objects is enabled by the following disclosed apparatus and method in which a horizontal work table supports a grid of brick formed of longitudinally aligned rows of brick arranged in end-to-end manner with each row of brick being immediately adjacent the next adjacent row of brick and with the brick also being provided in aligned transverse rows on the upper surface of the work table. A hydraulic cylinder actuated pusher beam is provided at one end of the work table for pushing the green brick rows longitudinally along the length of the work table beneath one of a plurality of individual embossing devices each of which is aligned with one of the longitudinal rows of brick. Each embossing device includes a vertically movable actuatable die operable to move vertically downward into contact with the upper face of a brick to be embossed. A new transverse row of green brick is provided on the upstream end of the work table at the beginning of each cycle of operation so as to be engaged by the pusher beam during the initial feed step of the next cycle of operation.

At least two transverse support beams extend transversely across the work table at an elevated distance above the work table and the green brick provided on the work table. Each transverse support beam supports a plurality of embossing devices with the number of embossing devices on each beam being equal to half the number of longitudinal rows of green brick so that the embossing devices on each particular beam are aligned with a brick in every other longitudinal row of green brick. The upstream support beam supports embossing devices that are actuated to engage the odd numbered longitudinal rows (i.e., 1, 3, 5, etc.) while the embossing devices on the downstream support beam are positioned in alignment with the even numbered longitudinal rows (2, 4, 6, etc.) of green brick for engaging such brick. Moreover, a reverse arrangement could also be used.

A plurality of inclined brick lifting ramps are positioned on the work table with each ramp being in vertical alignment with one of the embossing devices so that indexed movement of the green brick causes the green brick to ride upwardly on the ramp into an elevated position relative to the brick of the next adjacent lengthwise extending longitudinal row so that the elevated brick can be engaged by a vertically moveable die of each embossing device. The elevated positioning of the brick with respect to the brick in the next adjacent rows consequently precludes any contact or damage of the brick in the next adjacent rows by operation of the embossing device.

Producing this type of brick by the embossing apparatus and method of the present invention results in the desired textured face; however, the body of the brick remains basically unchanged and the individual brick units are stackable in linear stacks. It is consequently possible to use mechanical loading and unloading equipment to handle the embossed brick so as to avoid the hand labor and expense of prior green brick tumbling procedures.

Other objects, features and advantages of the present invention will be apparent to those of skill in the art upon a reading of this specification including the accompanying drawings.

BRIEF DESCRIPTION OF THE SEVERAL VIEWS OF THE DRAWINGS

The invention is better understood by reading the following Detailed Description of the Preferred Embodiments with reference to the accompanying drawing figures, in which like reference numerals refer to like elements throughout, and in which.

DETAILED DESCRIPTION OF THE INVENTION

Figure 1:
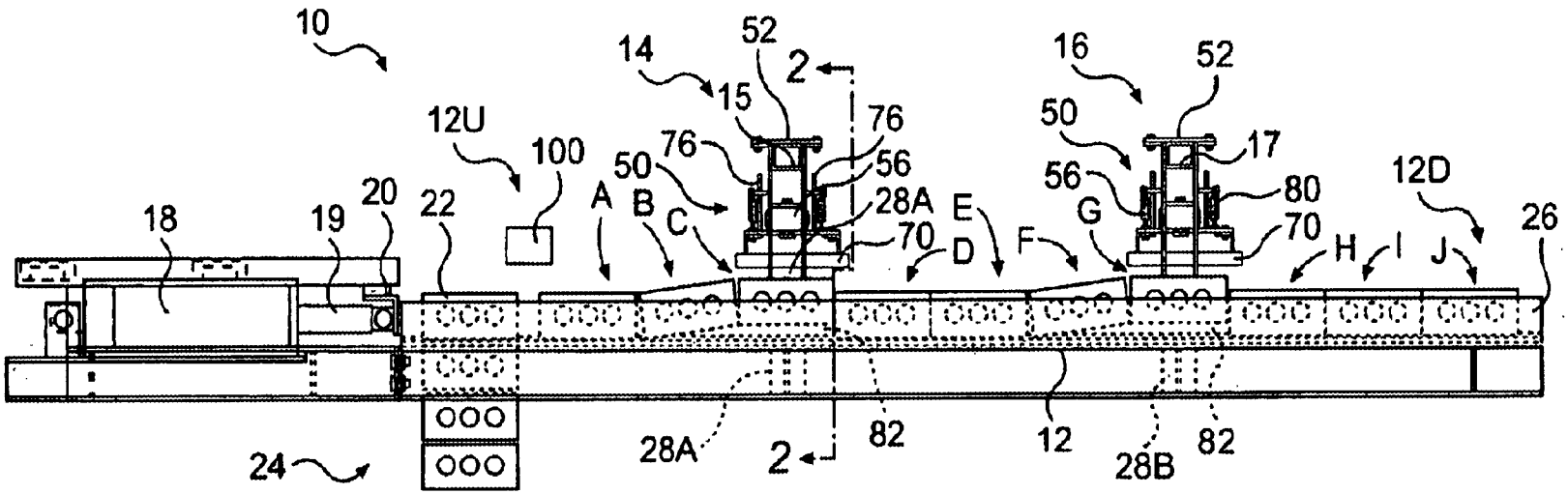
FIG. 1 is a section view of the preferred embodiment of the invention taken along lines 1—1 of FIG. 8.
Figure 2:
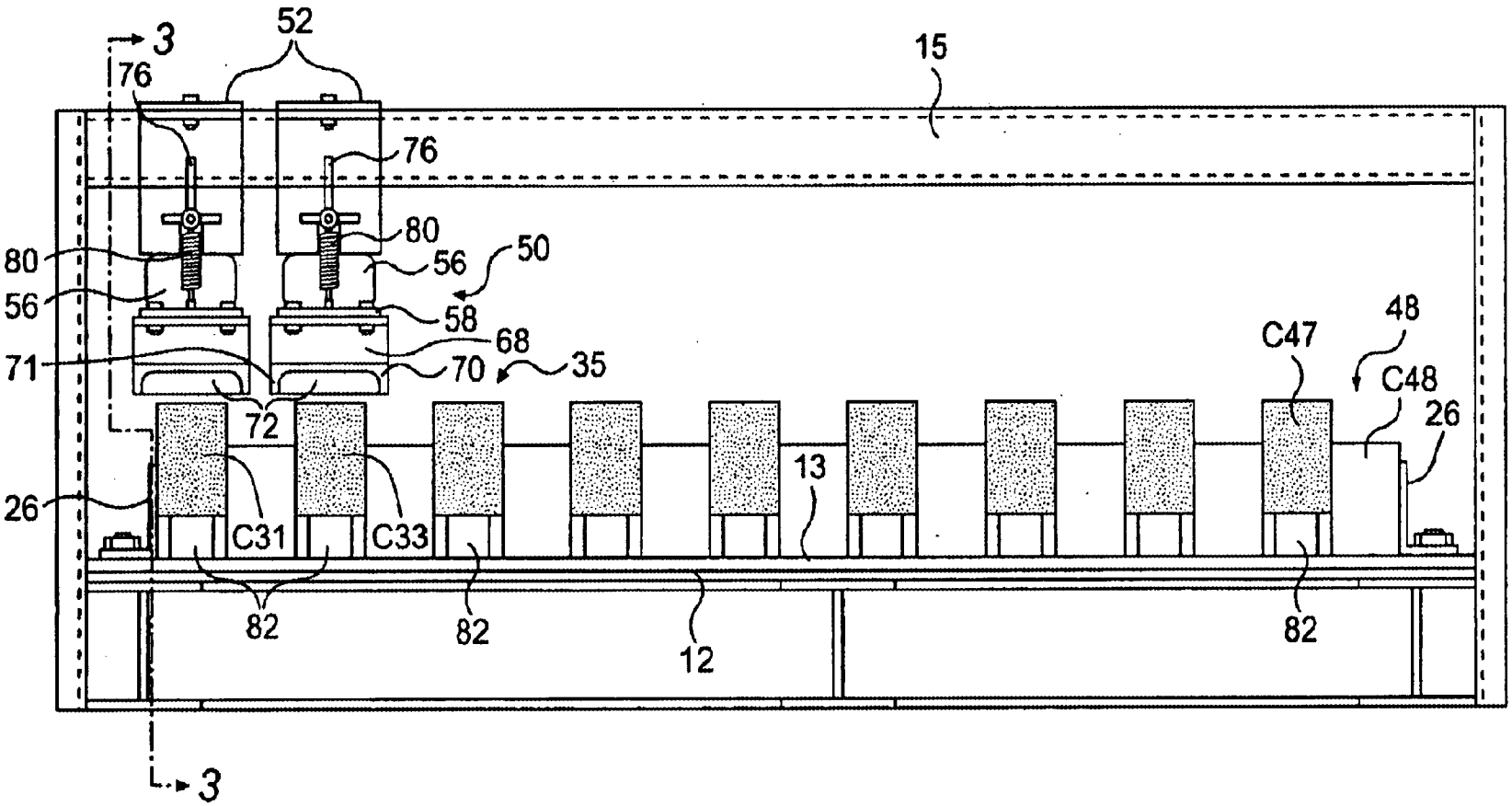
FIG. 2 is a sectional view taken along lines 2—2 of FIG. 1.
Figure 3:
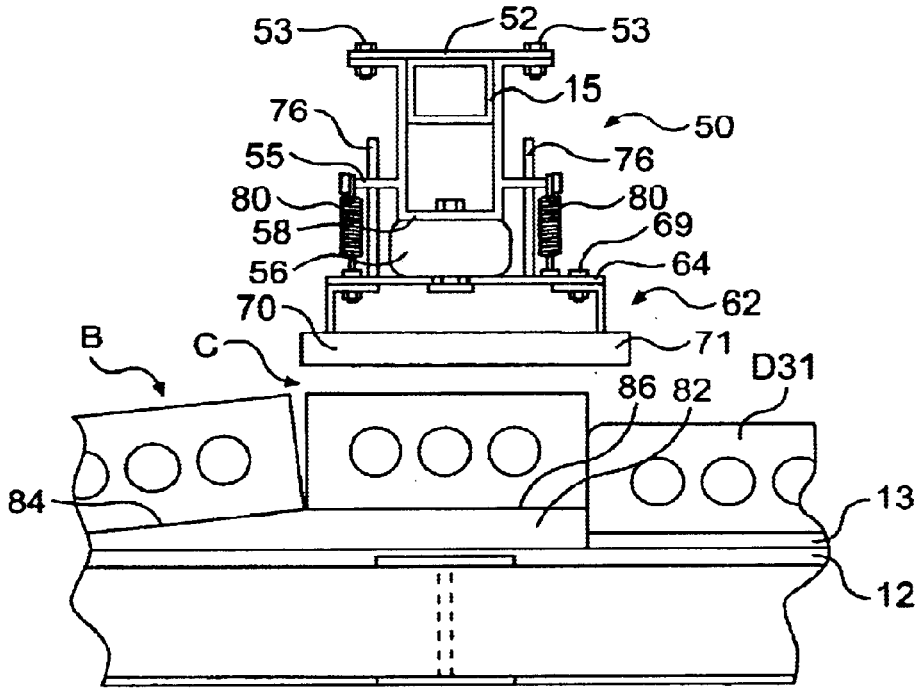
FIG. 3 is a sectional view taken along lines 3—3 of FIG. 2.

In describing preferred embodiments of the present invention illustrated in the drawings, specific terminology is employed for the sake of clarity. However, the invention is not intended to be limited to the specific terminology so selected, and it is to be understood that each specific element includes all technical equivalents that operate in a similar manner to accomplish a similar purpose.

Attention is initially invited to the drawings which illustrate a preferred embodiment of the invention, generally designated 10, the main components of which include an elongated, horizontal metal work table 12 having an upper surface supporting a panel 13 of ultra high molecular weight plastic having a low coefficient of friction to permit sliding movement of the green brick over its surface. Work table 12 also has an upstream end 12U and a downstream end 12D. A first or upstream transverse row 14 of embossing devices 50 mounted on a transverse upstream support beam 15 and a second or downstream transverse row 16 of embossing devices 50 mounted on a transverse downstream support beam 17 extend across work table 12.

Green bricks are fed to upstream end 12U of the table by a hydraulic cylinder and piston assembly 18 adjacent work table upstream end 12U having a piston rod 19 connected to a pusher 20 aligned with an uppermost transverse row of brick 22 of a stack 24 of green brick. The green brick are provided from conventional extruding and cutting equipment. Actuation of the hydraulic cylinder and piston assembly 18 causes pusher 20 to engage all of the uppermost row of brick 22 to move them in a downstream direction to the right onto the upstream end 12U of work table 12 where they are positioned in a first transverse row A in FIGS. 1 and 8. It should be understood that other conventional means such as a horizontal conveyor as disclosed in the Postell et al. U.S. Pat. No. 4,147,491 or others could also be used for positioning transverse rows of green brick for delivery to work table 12. Also, a servo or solenoid could be used in place of hydraulic cylinder 18.

Figure 8:
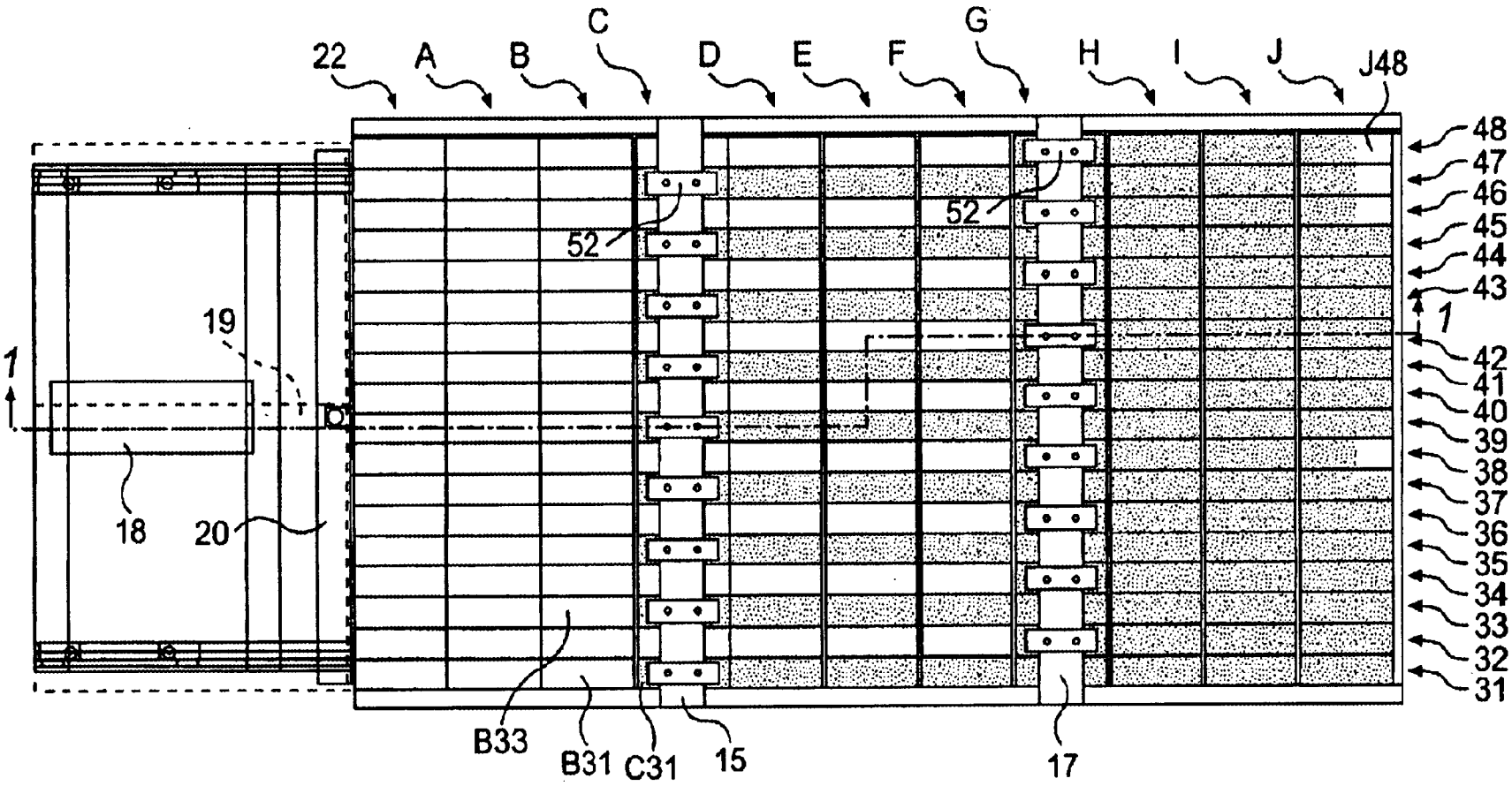
FIG. 8 is a top plan view of the apparatus with portions removed for purposes of clarity so as to illustrate the sequential method steps.
Figure 10:
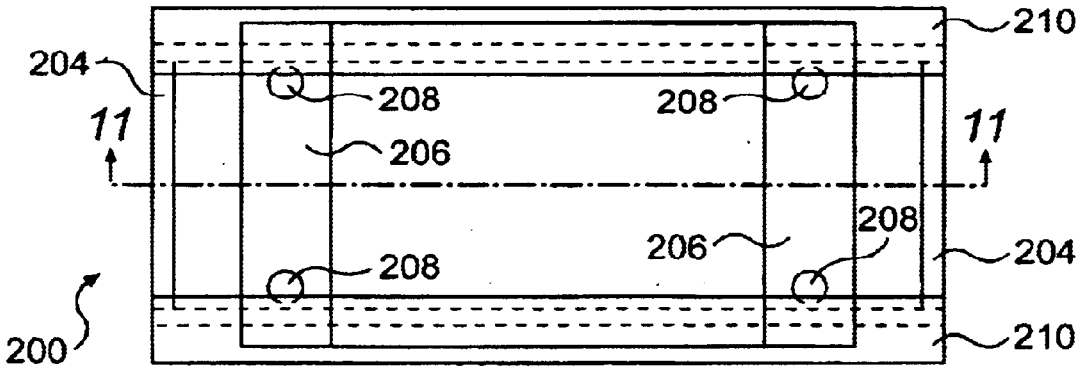
FIG. 10 is a bottom plan of an alternative structure for supporting alternative embossing members in each embossing device.
Figure 11:
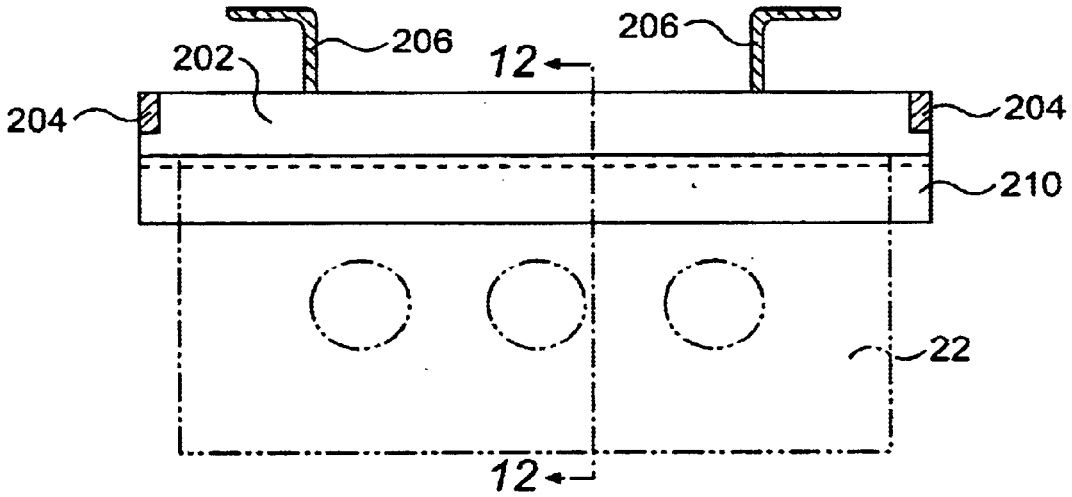
FIG. 11 is a sectional view taken along lines 11—11 of FIG. 10.
Figure 12:
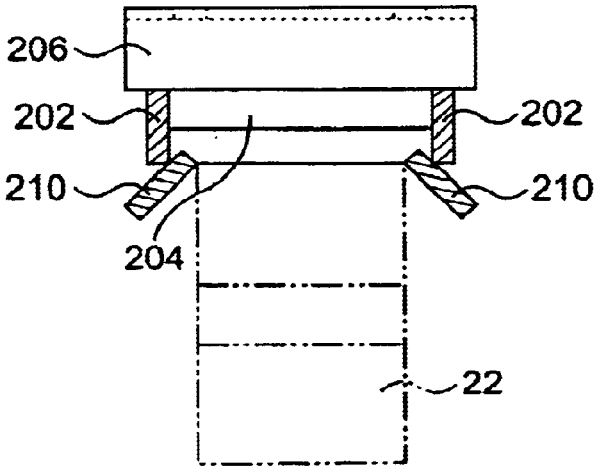
FIG. 12 is a sectional view taken along lines 12—12 of FIG. 10.
Figure 13:
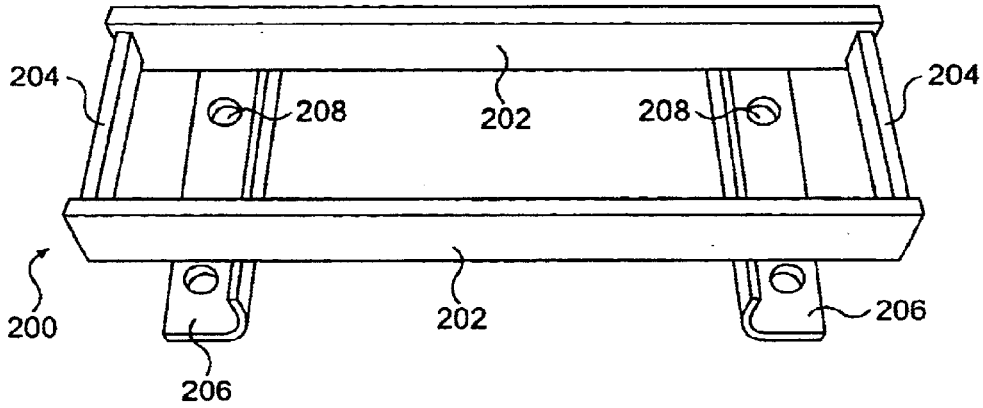
FIG. 13 is a top perspective view of the structure shown in FIG. 10.

The elongated metal work table 12 has side guards 26 positioned sufficiently far apart to permit the table to support unaltered smooth-faced green brick awaiting embossment and the brick which have been embossed in a grid formed of transverse rows A, B, C, D, E, F, G, H, I, J and K and longitudinal rows 31, 32, 33, 34, 35, 36, 37, 38, 39, 40, 41, 42, 43, 44, 45, 46, 47 and 48 in an end-to-end manner as shown in FIG. 8. In the following discussion certain individual bricks will be referred to by their coordinate location comprising the letter of their transverse row and the number of their longitudinal row; for example, the brick in lower end of row A as viewed in FIG. 8 would be referred to as "brick A31". It should also be noted that the brick which have not been embossed such as in transverse rows A and B are illustrated with a plain face surface whereas those brick such as C31 that are in a station to be embossed or which have been previously embossed such as D31 are shown with a stippled surface to distinguish them from the unembossed brick although they do not actually have a stippled surface.

The first or upstream transverse embossing device support beam 15 is supported by vertical column members 28A provided on opposite sides of work table 12. Similarly, vertical column members 28B are provided for supporting the second or downstream embossing device support beam 17 on which the second row 16 of embossing devices 50 is mounted. Transverse support beam 15 supports the first transverse row 14 of embossing devices 50, each individual embossing device 50 being vertically positioned above and in alignment with one of the odd number longitudinal rows of brick 31, 33, 35, 37, 39, 41, 43, 45 and 47 as shown in FIG. 8. Similarly, downstream transverse support beam 17 supports the second transverse row 16 of embossing devices 50, each of which is above and in alignment with one of the evenly numbered longitudinal rows 32, 34, 36, 38, 40, 42, 44, 46 and 48.

Figure 4:
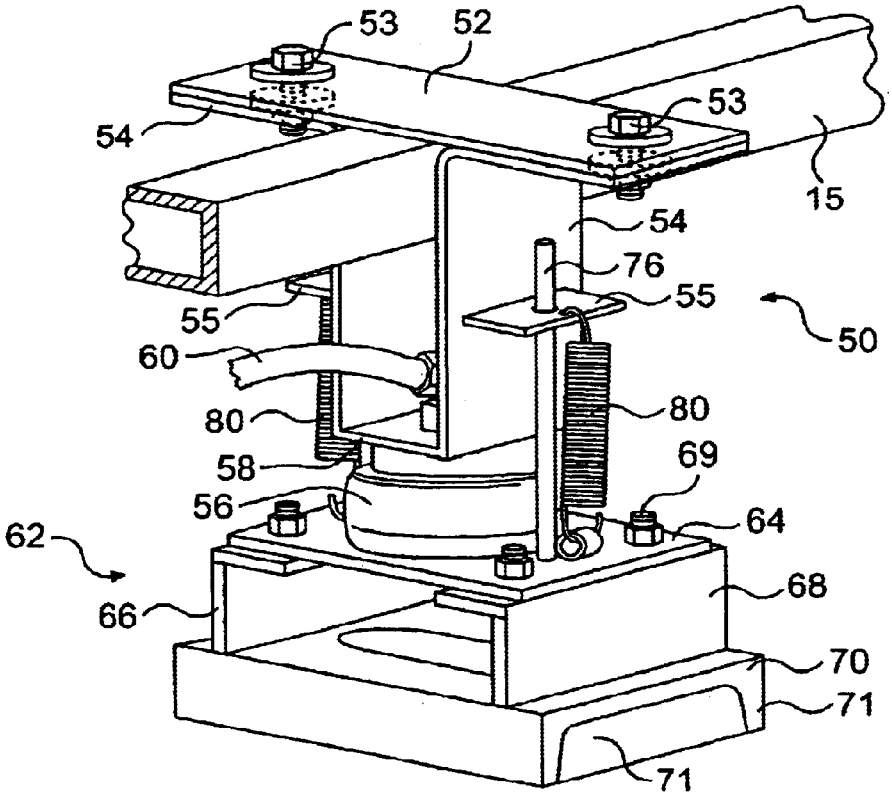
FIG. 4 is a front right side perspective view of one of the embossing devices.
Figure 5:
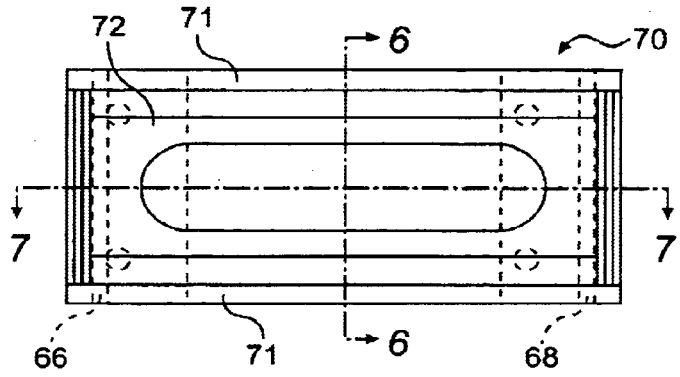
FIG. 5 is a bottom plan view of the means for supporting the embossing member in each embossing device.

Each of the embossing devices 50 is of identical construction, which will be discussed with reference being made to FIGS. 2, 3, 4, 5, 6 and 7. More specifically, each embossing device 50 includes a cap plate 52 extending transversely across the upper surface of its support beam such as beam 15 as shown in FIG. 4. A U-shaped hanger frame 54 is attached to cap plate 52 by fasteners such as nut and bolt 53 and extends downwardly from cap plate 52 along both sides of the supporting beam and provides support for a conventional expandable and inflatable bladder 56 which is inflated to move a die support 62 supported on the lower end of bladder 56 downwardly into contact with the upper face of green brick. Bladder 56 is of conventional construction and has been previously used for effecting vibration isolation of machinery. Bladder 56 is attached to and extends downwardly from lower horizontal plate component 58 of the U-shaped hanger frame 54. An air supply hose 60 is connected to the interior chamber of expandable bladder 56 for providing compressed air to the bladder for expanding the bladder to move die support 62 downwardly to initiate an embossing function. The bladder is expanded at a proper time of a cycle of operation for embossing the upper face of a brick positioned below and in alignment with the bladder by die support 62.

Figure 6:
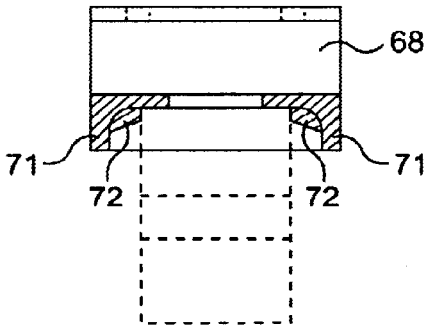
FIG. 6 is a sectional view taken along lines 6—6 of FIG. 5 additionally illustrating the embossing device in the support member along with a broken line illustration of a green brick in position to be embossed.
Figure 7:
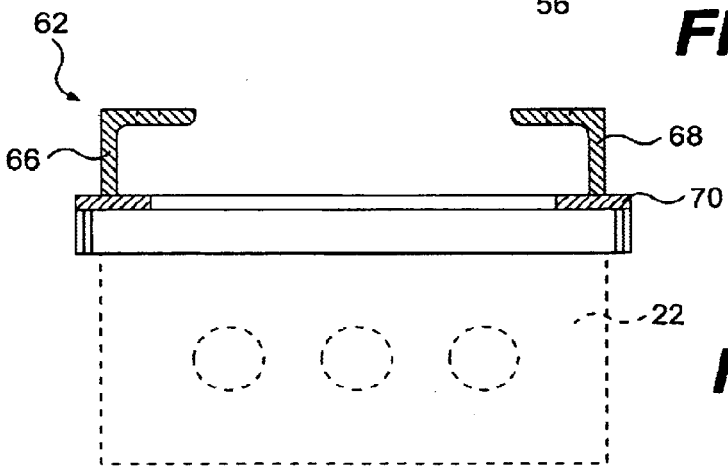
FIG. 7 is a sectional view taken along lines 7—7 of FIG. 5.

The die support 62 includes a carrier plate 64 (FIG. 4) from which angled members 66 and 68 extend downwardly. A die box 70 formed of a standard aluminum channel having side wings 71 extends downwardly from angle members 66 and 68 to which it is rigidly secured to provide a unitary structure. Embossing means such as an embossing die 72 formed of epoxy or aluminum is provided with a surface of desired embossing configuration and is mounted between the side wings 71 of die box 70 for engagement with the upper side face of a green brick 22 as shown in FIGS. 6 and 7. Such engagement occurs when expandable bladder 56 is inflated to cause the die support 62 and associated die elements to move linearly downwardly into pressing face-to-face contact with the upper face of the brick. In the particular embodiment illustrated in FIG. 6, the embossing die 72 only engages the upper comer edges of the brick to provide a Tudor rounded effect as shown by the upper left end of brick D31 in FIG. 3. However, it should be understood that the invention is not limited to the use of comer edge embossing dies and other embossing means engaging all or a portion of the upper face of the brick could be employed if desired.

Upon release of air pressure to the interior of expandable bladder 56, coil tension springs 80 extending between the side plates 55 of hanger frame 54 and carrier plate 64 act to return the moveable components 64, 68, etc. upwardly to their elevated deactivated position out of contact with any brick located beneath the die box 70. Guide rods 76 are fixedly attached at their lower ends to carrier plate 64 and extend upwardly through apertures in plate 55 to enable a smooth vertical movement of plate 64. It should be understood that other actuators such as a hydraulic cylinders, electric solenoids, or mechanical devices such as a cam gear could be used in place of expandable bladders 56. Similarly, solenoids or other actuators could be used in place of the hydraulic cylinder piston and rod assembly 18.

It is desirable to elevate each brick into an elevated position relative to its adjacent brick prior to embossing the brick. Such elevation is effected by a plurality of ramps 82 each having an inclined upstream surface 84 and a horizontal work support upper surface 86. Ramps 82 are fixedly attached to the work table with each ramp being in position beneath and aligned with a particular embossing device 50.

Figure 9:
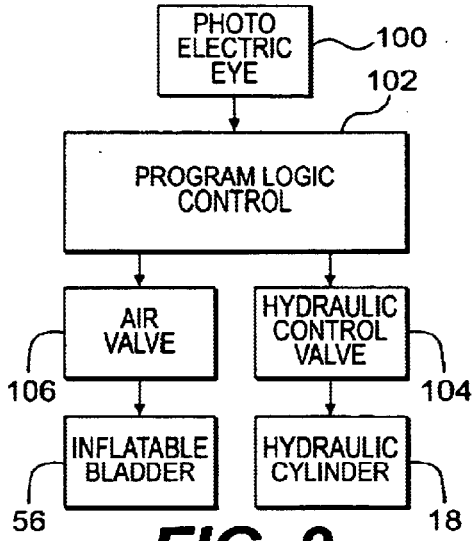
FIG. 9 is a block diagram of the control system of the preferred and other embodiments of the present invention.

Means for controlling the pusher 20 and the embossing devices 50 is shown in FIG. 9, and includes a photoelectric eye or other conventional proximity sensor 100 that senses movement of pusher 20 to its extended position to provide a signal to a conventional program logic control device (PLC) 102 which provides a control signal to a conventional hydraulic valve 104 which sends pressurized fluid to the rod end of cylinder 18 to effect retraction of pusher 20 to its retracted position to permit subsequent positioning of another row of brick 22 in feed ready position. The PLC 102 also provides a signal to a conventional air supply and control means such as an air valve 106 to effect opening of a compressed air supply valve to provide compressed air to hose 60 to inflate bladder 56 to move die box 70, etc. downwardly to emboss brick positioned in the work station below each die box. After a predetermined time delay, the PLC provides a further signal to effect venting of the bladder to permit springs 80 to return die box 70 to its elevated position at which time the apparatus is ready for initiation of another cycle of operation by the PLC to effect actuation of pusher 20. Each operation of pusher 20 indexes the brick on work table 12 a distance equal to the length of each brick.

Additional embodiments and variations of the invention are illustrated in FIGS. 10 through 14, which are directed to different variations of brick embossing means to be attached to the carrier plate 64. More specifically, FIGS. 10 through 14 disclose an alternative embodiment in which elongated brick-embossing metal plates 210 are employed for engaging and embossing the upper corner edge portions of green brick for effecting the formation of the brick.

Plates 210 are supported by a support frame 200 which consists of first and second metal carrier plates 202 which are connected by transverse end plates 204 which are welded to plates 202. Angled members 206 are welded to the upper edges of the metal carrier plates 202 and each include two mounting apertures 208 which are positioned to be alignable with the apertures in carrier plate 64 through which fasteners such as nuts and bolts 69 shown in FIG. 4 can be used for attaching support frame 200 to the expandable bladder 56 shown in FIG. 4 or an alternative actuator as described above. Elongated metal embossing plates 210 are welded to the metal carrier plates 202 in the manner shown in FIG. 12.

Figure 14:
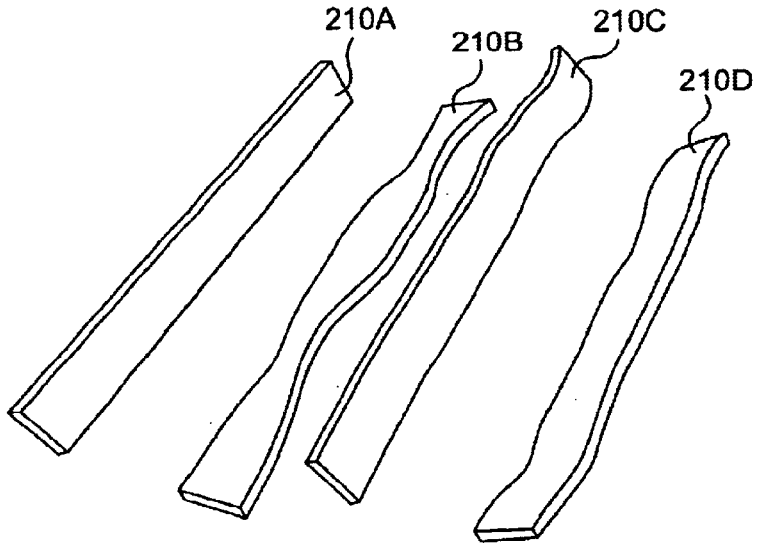
FIG. 14 is a top perspective view of irregular embossing plates usable on the structure shown in FIG. 13.

The elongated metal embossing plates 210 can have an unlimited number of shapes including a generally planar or slightly twisted shape such as plate 210A or they can be of irregular distorted or undulating shapes such as elongated metal embossing plates 210B, 210C and 210D of FIG. 14. It should be understood that the invention is not limited to the embossing plates as shown in the drawings and the variations in the shape of the embossing plates is infinite. Thus, the umber of potential brick designs created by use of the metal embossing plates is unlimited and will increase to proportion to the number of different embossing plate designs employed in the apparatus.

Modifications and variations of the above-described embodiments of the present invention are possible and will be appreciated by those skilled in the art in light of the above teachings. For example, it would also be possible to add a third row of embossing devices identical to rows 15 and 16 downstream of row 16 to permit additional embossing of previously embossed brick or to increase total capacity and increase the possible number of brick designs by adding additional longitudinal rows of brick.

It is therefore to be understood that, within the scope of the appended claims and their equivalents, the invention may be practiced otherwise than as specifically described.

What is claimed is:

1. An apparatus for embossing green brick having longitudinal and transverse dimensions, first and second edge faces, upper and lower faces, a forward end face and a rearward end face to provide an aged effect, said apparatus comprising:

a) a flat work table having a lengthwise dimension extending between upstream and downstream ends of said work table and a transverse dimension and having an upper surface supporting a grid array of brick comprising plural lengthwise aligned rows of brick and plural transverse aligned rows of brick;

b) a first transverse row of embossing devices positioned above the work table, each of said embossing devices being aligned with alternate ones of said lengthwise aligned rows;

c) a second transverse row of embossing devices positioned downstream of said first transverse row of embossing devices with each embossing device being aligned with one of the lengthwise extending rows that is not aligned with any of the embossing devices of said first transverse row of embossing devices;

d) a pusher for indexing transverse rows of green brick in a downstream direction on said work table a distance equal the longitudinal dimension of each brick;

e) said embossing devices each including a die mounted for linear downward vertical movement toward said work table to engage a stationary green brick positioned beneath the respective embossing device; and f) control means for sequentially actuating said pusher and said embossing devices to move said pusher from a home position to an extended position to move said transverse row of green brick on to the work table a distance equal to the length of the green brick followed by both return of the pusher to the home position and simultaneous actuation of all of said embossing devices and subsequent initiation of a second cycle of operation.

2. An apparatus as recited in claim 1, additionally including a brick elevating ramp on said work table beneath each of said embossing devices for receiving and elevating each brick above the work table and above adjacent bricks in all adjacent longitudinal rows as each brick is indexed into position beneath each respective embossing device.

3. An apparatus as recited in claim 1, wherein each embossing device includes an inflatable air bladder which when inflated urges the die downwardly into contact with a face of a green brick dwelling beneath the embossing device.

4. An apparatus as recited in claim 2, wherein each embossing device includes an inflatable air bladder which when inflated urges the die downwardly into contact with the side face of a green brick dwelling beneath the embossing device.

5. An apparatus as recited in claim 1, additionally including a third transverse row of embossing devices positioned above the work table at a location downstream of said second transverse row of embossing devices.

6. An apparatus as recited in claim 5, wherein said third transverse row of embossing devices has individual embossing devices longitudinally aligned with an embossing device in either the first or second rows of embossing devices so as to effect a second impression of design on brick previously embossed by an embossing device in the first or second transverse rows of embossing devices.

7. An apparatus as recited in claim 5, additionally including a brick elevating ramp on said work table beneath each of said embossing devices for receiving and elevating each brick above the work table and above bricks in the adjacent longitudinal row as each brick is indexed into position beneath each respective embossing device.

8. An apparatus as recited in claim 5, wherein each embossing device includes an inflatable air bladder which when inflated urges the die downwardly into contact with the side face of a green brick dwelling beneath the embossing device.

9. An apparatus as recited in claim 1, wherein said die includes a support frame, first and second elongated embossing plates attached to said support frame and positioned to engage the upper side edges of said stationary green brick for deforming the green brick.

10. An apparatus as recited in claim 9, wherein said elongated embossing plates are canted toward each other at their upper portions.

11. An apparatus as recited in claim 10, wherein at least one of said embossing plates is of an undulating configuration.

* * * * *